US006883900B2

(12) United States Patent
Furukawa

(10) Patent No.: US 6,883,900 B2
(45) Date of Patent: Apr. 26, 2005

(54) IMAGE FORMING METHOD AND IMAGE FORMING APPARATUS

(75) Inventor: Koji Furukawa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/270,685

(22) Filed: Oct. 16, 2002

(65) Prior Publication Data

US 2003/0085958 A1 May 8, 2003

(30) Foreign Application Priority Data

Oct. 18, 2001 (JP) ..... P. 2001-320549
Nov. 19, 2001 (JP) ..... P. 2001-353175

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 3,887,928 A 6/1975 Ohno et al.
5,619,234 A * 4/1997 Nagato et al. ..... 347/55

FOREIGN PATENT DOCUMENTS

| | | |
|---|---|---|
| EP | 0 435 549 A2 | 7/1991 |
| JP | 5-116322 | 5/1993 |
| JP | 9-234870 | 9/1997 |
| JP | 2001-030497 | 2/2001 |
| JP | 2002-137420 | 5/2002 |

* cited by examiner

*Primary Examiner*—Raquel Yvette Gordon
(74) *Attorney, Agent, or Firm*—Sughrue Mion, PLLC

(57) ABSTRACT

An image forming method comprises steps of: ejecting charged matter applied an external force from a recording head placed opposed to a record medium; applying a voltage to an intermediate electrode installed between the recording head and the record medium and controlling flying of the ejected charged matter; applying a predetermined voltage to an auxiliary electrode placed between the intermediate electrode and the recording head, and controlling a potential gradient between the recording head and the intermediate electrode; and hitting the charged matter on the record medium.

9 Claims, 3 Drawing Sheets

IMAGE FORMING METHOD AND IMAGE FORMING APPARATUS

BACKGROUND OF THE INVENTION

This invention relates to an image forming method and an image forming apparatus for ejecting and hitting charged matter onto a record medium for forming an image.

With improvement in the recent digital drawing technology, attention has been focused on an image record technique for ejecting recording material directly onto a record medium for forming an image without the need for a process of developing, etc. For example, a toner jet record technique is a technique for ejecting powder toner from a recording head to a record medium opposed thereto by the electrostatic force of an electric signal. An ink jet technique of using liquid ink in place of powder toner and ejecting ink droplets from a recording head to a record medium opposed thereto by an external force makes it possible to easily miniaturize a record apparatus because the size of the recording head is small, and is widely in the actual use. The ink droplet jetting techniques include a technique of using piezo elements deformed in response to an electric signal, a technique of using heating resistors for generating heat in response to an electric signal, a technique of using ultrasonic generation elements for generating ultrasonic waves in response to an electric signal, a technique of using the electrostatic force of an electric signal, and the like.

By the way, considering the maintainability of a record apparatus and the transportability of record media, it is desirable that the spacing between a recording head and a record medium should be widened. However, in the technique of using piezo elements, the technique of using heating resistors, and the technique of using ultrasonic generation elements, the jet speed is slow and if the spacing between the recording head and the record medium is widened, the hit position becomes unstable; this is a problem. If the spacing between the recording head using the electrostatic force and the record medium is widened, a high-voltage pulse signal becomes necessary and consequently a control section becomes very expensive; this is a problem.

To solve such problems, a method of using powder toner or liquid toner containing charged matter as a recording material and installing an intermediate electrode between a recording head and a record medium for controlling flying of ejected charged matter is known.

FIG. 5 shows the configuration wherein an intermediate electrode 3 is placed between a recording head 1 and a record medium 5. In FIG. 5, a toner ejection part 11 is opened in a part of the top face of the recording head 1 and an ejection part electrode 2 is placed in the proximity of the ejection part 11 in the outer peripheral portion of the surface of the ejection part 11. A rear electrode 4 on which the record medium 5 is placed is disposed opposed to the recording head 1. The intermediate electrode 3 is disposed between the ejection part electrode 2 and the rear electrode 4 and a stable electric field is formed between the recording head 1 and the intermediate electrode 3 regardless of the distance between the recording head 1 and the record medium 5. As the voltages applied to the electrodes, for example, if the toner (charged matter) particles ejected from the ejection part 11 are positively charged, 0 V is applied to the rear electrode 4, 500 V to the intermediate electrode 3, and 1000 V to the ejection part electrode 2.

The toner ejected from the ejection part 11 of the recording head 1 is first accelerated by an electric field formed by the ejection part electrode 2 and the intermediate electrode 3 (see equipotential line 50) and ejecting of the toner is controlled. Further, the toner passing through the intermediate electrode 3 is accelerated by an electric field formed by the intermediate electrode 3 and the rear electrode 4, is ejected toward the rear electrode 4, and is hit at a predetermined position on the record medium 5.

As described above, as compared with the applied voltage for only the ejection part electrode 2 and the rear electrode 4 to form the electric field for accelerating the particles of the toner ejected from the ejection part 11 and controlling flying, the intermediate electrode 3 is placed between the ejection part electrode 2 and the rear electrode 4 and an electric field is formed by the ejection part electrode 2 and the intermediate electrode 3, whereby the electric field for accelerating the toner ejected from the ejection part 11 and controlling flying can be formed at lower applied voltage and a power unit can be miniaturized.

In the technique of using piezo elements, the technique of using heating resistors, and the technique of using ultrasonic generation elements as the external force for ejecting the charged matter by controlling flying of the toner of the charged matter ejected from the ejection part 11 by the electric field formed by the intermediate electrode 3, if the spacing between the recording head 1 and the record medium 5 is widened, the hit position becomes stable, making it possible to conduct a good image formation as the toner is accelerated by the electric field formed by the ejection part electrode 2 and the intermediate electrode 3.

As described above, the image forming apparatus for ejecting the charged matter directly to the record medium 5 for forming an image comprises the intermediate electrode 3, so that good electric field formation and miniaturization of the apparatus can be accomplished. However, if the intermediate electrode 3 is provided solely, anew dielectric (base material 31 of the intermediate electrode) exists between the recording head 1 and the record medium 5, a steep potential gradient from the ejection part 11 to the intermediate electrode 3 occurs, an electrostatic force acts on the toner along the electric field line (see the equipotential line 50) diverged in the direction of the intermediate electrode 3 from the ejection part 11 of the recording head 1, and the toner ejecting direction is disordered relative to the electric field line direction. Thus, a high-quality image cannot be formed on the record medium 5; this is a problem.

SUMMARY OF THE INVENTION

It is therefore an object of the invention to provide an image forming method and an image forming apparatus for making it possible to form a good electric field between a recording head and an intermediate electrode for stably flying charged matter for forming a good image.

To the end, according to the invention of a first aspect, there is provided an image forming method comprising steps of: ejecting charged matter from a recording head placed opposed to a record medium by applying an external force to the charged matter; applying a voltage to an intermediate electrode installed between the recording head and the record medium and controlling flying of the ejected charged matter; applying a predetermined voltage to an auxiliary electrode placed between the intermediate electrode and the recording head, and controlling a potential gradient between the recording head and the intermediate electrode; and hitting the charged matter on the record medium.

According to the invention of the first aspect, if the predetermined voltage is applied to the auxiliary electrode, the potential gradient in the direction of the intermediate electrode from the recording head is decreased and the electric field line diverged in the direction of the intermediate electrode is weakened, so that a good electric field can be formed between the recording head and the intermediate electrode and the charged matter can be stably ejected without disordering the ejecting direction of the charged matter for forming a good image on the record medium.

According to the invention of a second aspect, there is provided an image forming apparatus comprising: an ejection part electrode (ejection part electrode 2) placed in the proximity of an ejection part of a recording head placed opposed to a record medium; an intermediate electrode (intermediate electrode 3) placed between the recording head and the record medium; an auxiliary electrode (auxiliary electrode 6) placed between the recording head and the intermediate electrode; and voltage applying unit applying predetermined voltages to the ejection part electrode, the intermediate electrode, and the auxiliary electrode, wherein the charged matter ejected from the ejection part (ejection part 11) of the recording head (recording head 1) placed opposed to the record medium (record medium 5) flies by applying the external force to the charged matter and hits on the record medium, thereby forming an image on the recording medium.

In the above construction of the present invention, it is preferable that the auxiliary electrode is placed close to the center axis extending from the top of the recording head.

According to the invention of the second aspect, the voltage applying unit applies the predetermined voltages to the ejection part electrode, the intermediate electrode, and the auxiliary electrode, whereby the electric field line diverged in the direction of the intermediate electrode from the recording head is weakened, so that a good electric field can be formed between the recording head and the intermediate electrode and the charged matter can be stably ejected without disordering the ejecting direction of the charged matter for forming a good image on the record medium.

The invention of a third aspect is characterized by the fact that the auxiliary electrode further comprises a base material of the auxiliary electrode, the base material being a material having a dielectric constant of 3 or less. According to the invention of the third aspect, the base material of the auxiliary electrode is a material having a low dielectric constant of 3 or less, so that generating a new electric field line diverging to the base material of the auxiliary electrode is suppressed, and thereby, the flying direction of the charged matter is prevented from jumbling.

The invention of a fourth aspect is characterized by the fact that the intermediate electrode further comprises a base material of the intermediate electrode, and the edge of the base material is formed at an acute angle. According to the invention of the fourth aspect, the edge of the intermediate electrode is formed at an acute angle (45 degree or less, preferably 20 degrees or less), so that the base material of the intermediate electrode is located away from the charged matter ejection part of the recording head, whereby the electric field line can be prevented from concentrating on the material having a high dielectric constant so as not to adversely affect electric field formation in the proximity of the recording head.

The invention of a fifth aspect is characterized by the fact that the voltage applying unit applies predetermined voltages to the intermediate electrode, the ejection part electrode, and the auxiliary electrode so as to satisfy relation $V1<V2\leqq V3$ in the case of that the polarity of the charged matter is positively charged and satisfy relation $V1>V2\geqq V3$ in the case of that the polarity of the charged matter is negatively charged and wherein V1 is the voltage applied to the intermediate electrode, V2 is the voltage applied to the ejection part electrode, and V3 is the voltage applied to the auxiliary electrode.

According to the invention of the fifth aspect, for example, to positively charge the ejected charged matter, in the case of that the voltage applying unit applies 500 V to the intermediate electrode 3, 1500 V to the auxiliary electrode 6, and 1000 V to the ejection part electrode 2, for example, so as to satisfy the condition, the potential gradient in the direction of the intermediate electrode from the recording head is decreased and the electric field line diverged in the direction of the intermediate electrode is weakened, so that the charged matter can be stably ejected and hit on the record medium without disordering the ejecting direction of the charged matter.

The invention of a sixth aspect is characterized by the fact that the image forming apparatus further comprises an acceleration unit for accelerating the charged matter ejected from the recording head by an air flow. According to the invention of the sixth aspect, as the charged matter is accelerated with the aid of an air flow, it is made possible to eject the charged matter at high speed, so that the straight movability of the charged matter can be improved against the electric field line diverged in the direction of the intermediate electrode from the recording head.

The invention of a seventh aspect is characterized by the fact that further comprises a vibration applying unit for vibrating the recording head. According to the invention of the seventh aspect, as vibration is applied to the recording head, moving the charged matter to the ejection part can be promoted, so that it is made possible to supply the charged matter quickly.

DETAILED DESCRIPTION OF THE PREFERRED EMBODIMENTS

Figure 1:
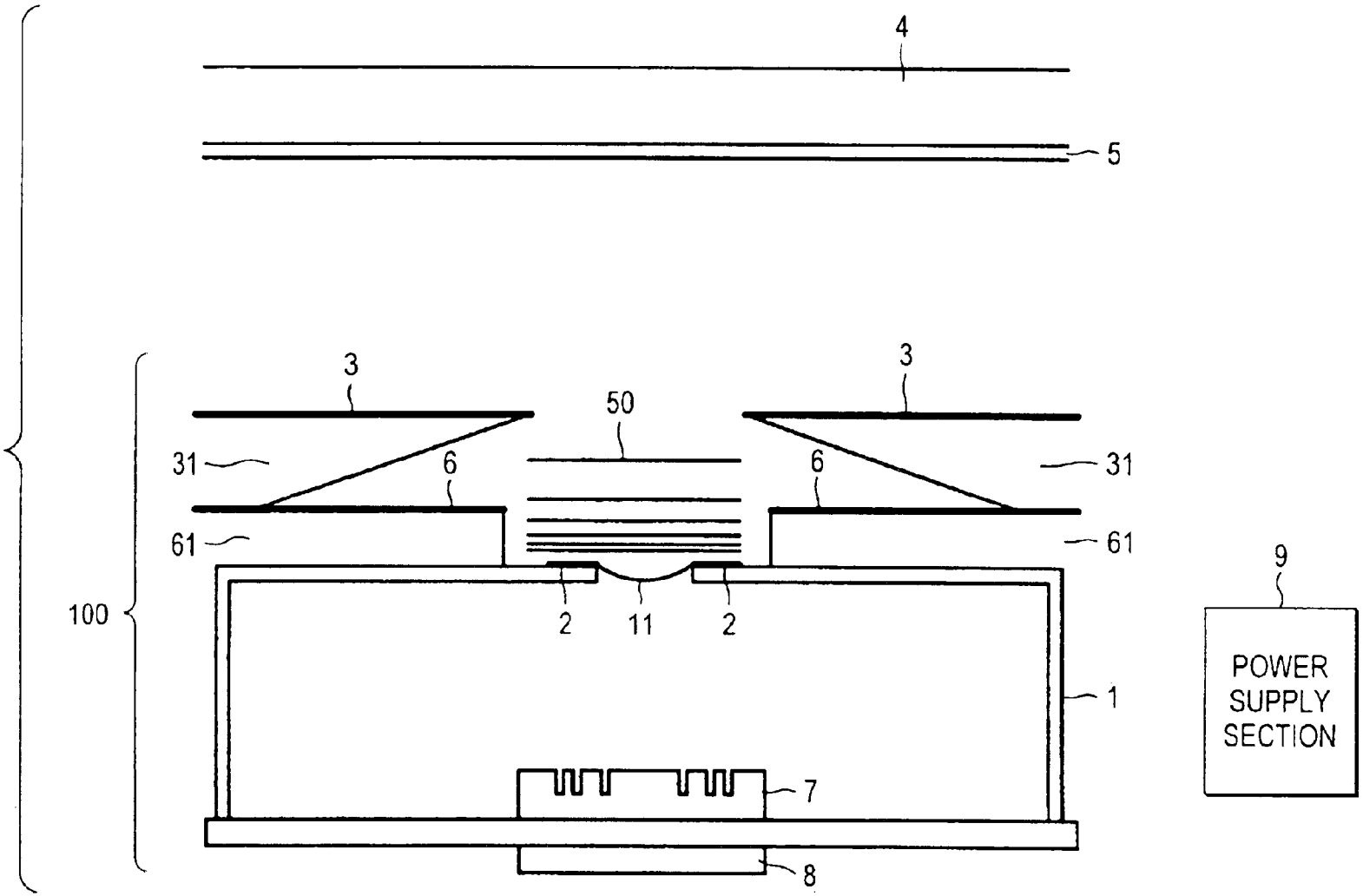
FIG. 1 is a drawing to show the configuration of one embodiment of an image forming apparatus of the invention.
Figure 5:
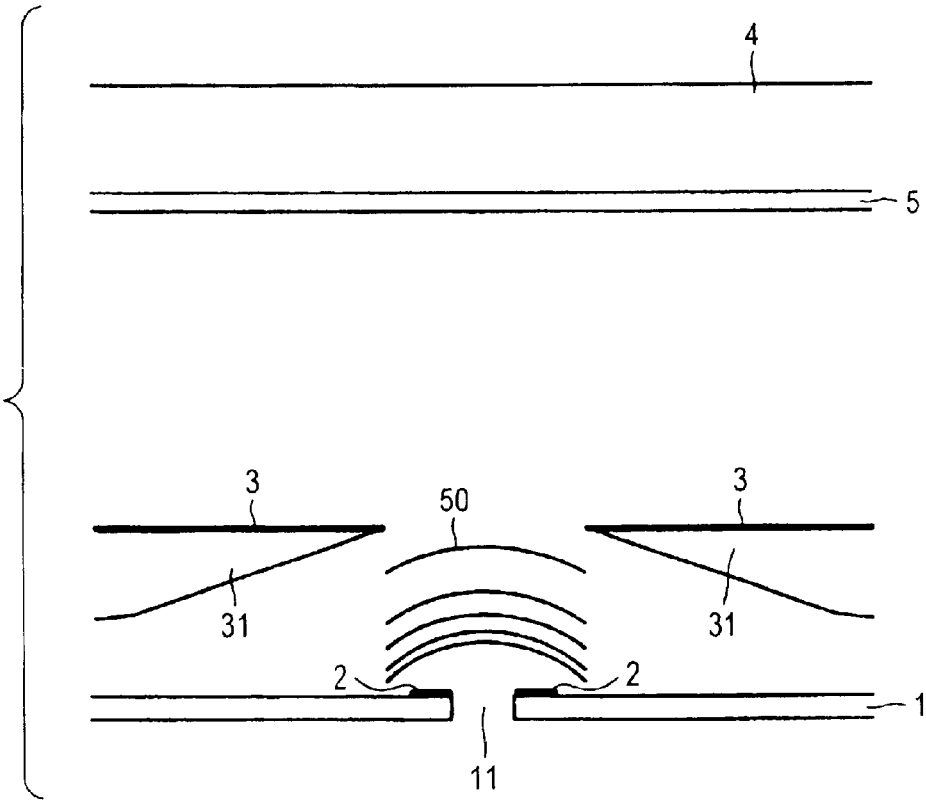
FIG. 5 is a drawing to show the configuration of an image forming apparatus in a related art.

Referring now to the accompanying drawings, there is shown a preferred embodiment of the invention. FIG. 1 is a drawing to show the configuration of one embodiment of an image forming apparatus of the invention. Parts similar to those previously described with reference to FIG. 5 are denoted by the same reference numerals in FIG. 1 and will not be discussed again in detail.

In FIG. 1, the image forming apparatus has a recording head 1 storing liquid toner, for example, of charged matter, an ejection part electrode 2 placed in the proximity of an ejection part 11 in the outer surrounding of the ejection part 11 opened in a part of a top face member forming a part of the recording head 1, a rear electrode 4 being opposed to the recording head 1 and placed in the rear of a record medium 5 for attracting toner ejected from the recording head 1, an intermediate electrode 3 for forming a good electric field between the ejection part electrode 2 and the rear electrode 4 and suppressing a hit position shift of the toner, an auxiliary electrode 6 for flattening the potential gradient in the direction of the intermediate electrode 3 from the recording head 1 and weakening the electric field line diverged in the direction of the intermediate electrode 3, and a power supply section (voltage applying unit) 9 for applying predetermined voltages to the ejection part electrode 2, the intermediate electrode 3, the auxiliary electrode 6, and the rear electrode 4, wherein the ejection part 11 for ejecting toner is opened in a part of the top face member forming the recording head 1, a piezoelectric element 8 of an ultrasonic generation element is mounted on the outside of a rear member forming a part of the recording head 1, and a Fresnel lens 7 for concentrating an ultrasonic wave on the ejection part 11 is placed opposed to the piezoelectric element 8 in a rear part in the recording head 1. Wiring of the power supply section 9 to the ejection part electrode 2, the intermediate electrode 3, the auxiliary electrode 6, and the rear electrode 4 is not shown in the figure.

The auxiliary electrode 6 and the intermediate electrode 3 are deposited in order on the recording head 1, and they form a head section 100 in one piece. The metal portion of the auxiliary electrode 6 (the solid line portion in the figure) is formed on the record medium 5 side from the top face of the recording head 1 and the metal portion of the intermediate electrode 3 (the solid line portion in the figure) is also formed on the record medium 5 side. The power supply section 9 can apply voltages separately to the ejection part electrode 2 of the recording head 1, the auxiliary electrode 6, and the intermediate electrode 3.

Further, preferably a base material portion 61 of the auxiliary electrode 6 other than the metal electrode thereof is formed of a material having a low dielectric constant (3 or less), such as plastic, glass, or ceramics, to suppress formation of an unnecessary electric field line. To form the metal electrode, a known method of vacuum evaporation, sputtering, etc., of a conductive material like aluminum, nickel, chromium, gold, platinum, etc., is applied to the base material portion. Further more, even where the material having a low dielectric constant is employed, in a state that the dielectric is placed in the proximity of the ejection part 11, electric field formation in the proximity of the ejection part 11 is adversely affected. Thus, the edge of the surrounding of a hole or a slit made in the intermediate electrode 3 is formed at an acute angle (45 degrees or less, preferably 20 degrees or less).

Here, the distance between the ejection part 11 of the head section 100 and the record medium 5 is, for example, 1200 $\mu$m, the distance between the intermediate electrode 3 of the head section 100 and the record medium 5 is, for example, 1000 $\mu$m, and the hole diameter or the slit width of the intermediate electrode 3 is 300 $\mu$m (100 $\mu$m to 500 $\mu$m). The distance between the ejection part 11 and the edge of the intermediate electrode 3 is 200 $\mu$m and the distance between the ejection part 11 and the auxiliary electrode 6 is 50 $\mu$m (the distance between the auxiliary electrode 6 and a center line produced from the top of the recording head 1 is 200 $\mu$m). In addition to this, between the hole diameter and the slit of the intermediate electrode 3, it is necessary that the slit width is narrower than the hole diameter.

The operation of the image forming apparatus of the embodiment is as follows: First, the power supply section 9 can separately control the applied voltage to the ejection part electrode 2 of the recording head 1, the applied voltage to the auxiliary electrode 6, and the applied voltage to the intermediate electrode 3. If the toner (charged matter) ejected from the ejection part 11 is positively charged, the power supply section 9 supplies 0 V to the rear electrode 4, 500 V to the intermediate electrode 3, 1500 V to the auxiliary electrode 6, and 1000 V to the ejection part electrode 2, for example. If the toner ejected from the ejection part 11 is negatively charged, the power supply section 9 supplies 0 V to the rear electrode 4, −500 V to the intermediate electrode 3, −1500 V to the auxiliary-electrode 6, and −1000 V to the ejection part electrode 2, for example. In the example, the case where the toner is positively charged will be discussed.

When an ultrasonic wave is generated from the piezoelectric element 8 in response to an electric signal for image formation, the ultrasonic wave is concentrated through the Fresnel lens 7 on the liquid toner surface of the ejection part 11 and the toner is ejected from the ejection part 11 to the outside. The ejected toner is directed in the direction of the intermediate electrode 3 by the electric field formed by the ejection part electrode 2 and the intermediate electrode 3. The electric field diverged in the direction of the intermediate electrode 3 is weakened by the auxiliary electrode 6 and thus the toner is moved in a straight line along the straight electric field (see the equipotential line 50). Therefore, ejecting of the toner ejected from the ejection part 11 of the recording head 1 is controlled by the intermediate electrode 3 and the auxiliary electrode 6 with good dot placement accuracy and very stably. The toner passing through the hole of the intermediate electrode 3 is further attracted linearly toward the record medium 5 placed on the rear electrode 4 by the electric field formed between the intermediate electrode 3 and the rear electrode 4 and is hit precisely at a predetermined position on the record medium 5.

Next, the function of the auxiliary electrode 6 will be discussed. The voltage applied to the auxiliary electrode 6 is a voltage required for reducing the potential gradient from the recording head 1 to the intermediate electrode 3 occurring because of addition of the intermediate electrode 3 and weakening the electric field diverged in the direction of the intermediate electrode 3. For this purpose, letting the applied voltage to the intermediate electrode 3 be V1, the applied voltage to the ejection part electrode 2 be V2, and the applied voltage to the auxiliary electrode 6 be V3, it is necessary to satisfy the relation $V1<V2\leqq V3$ among the voltages.

While the relation is satisfied, the range of the applied voltage V3 to the auxiliary electrode 6 depends on the distance between the center axis extending from the top of the recording head 1 and the auxiliary electrode 6 and if the auxiliary electrode 6 is placed close to the center axis, the potential gradient from the recording head 1 to the intermediate electrode 3 can be flattened at almost the same voltage as the voltage V2. However, as the distance between the center axis and the auxiliary electrode 6 increases, the applied voltage V3 can be raised in response to the distance for strengthening the electric field given onto the center axis and decreasing the potential gradient. The above-described specific voltages applied to the electrodes are determined so that the applied voltage V3 to the auxiliary electrode 6 (1500 V) satisfies the above-mentioned relation and range; the applied voltage to the auxiliary electrode 6 can eliminate the electric field line diverged in the direction of the intermediate electrode 3 from the recording head 1 and can form the potential gradient moved in a straight line from the recording head 1 to the intermediate electrode 3.

Figure 2:
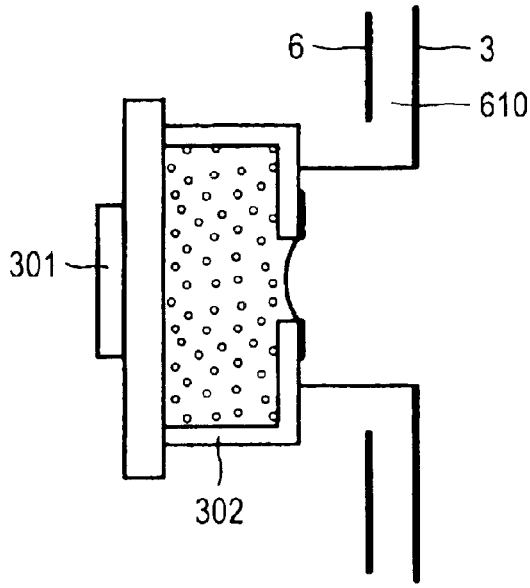
FIG. 2 is a drawing to show supply means using vibration.

According to the embodiment, the auxiliary electrode 6 is placed between the recording head 1 and the intermediate electrode 3, whereby the electric field line diverged in the direction of the intermediate electrode 3 from the ejection part 11 of the recording head 1 can be corrected in the straight line direction for reducing the diverged potential gradient. Accordingly, the jet path of the toner ejected from the ejection part 11 of the recording head 1 is not disordered and the toner is moved in a straight line and can be hit precisely on the record medium 5. Therefore, a good image formation can be conducted. Of course, the intermediate electrode 3 is provided, whereby the applied voltage to the recording head 1 itself can be lowered and the power supply section 9 can be miniaturized. In the embodiment, the mode of depositing the auxiliary electrode 6 and the intermediate electrode 3 on the recording head 1 is shown, but the auxiliary electrode 6 and the intermediate electrode 3 may be installed separately or may be formed in one piece without departing from the spirit and the scope of the invention. For example, as shown in FIG. 2, the auxiliary electrode 6 and the intermediate electrode 3 may be a solid construction. In this situation, a base material of the electrode 610 preferably has a low dielectric constant.

In the embodiment, the mode is shown in which the rear electrode 4 is installed in the rear of the record medium 5 and voltage is applied to the rear electrode 4 to form electric field of the ejection part electrode 2 and the intermediate electrode 3 and the record medium 5. However, a charger may be installed for charging the record medium 5, thereby forming an electric field. In this case, for example, if the record medium 5 is charged with −1000 V by the charger and −500 V is applied to the intermediate electrode 3, 500 V to the auxiliary electrode 6, and 0 V to the ejection part electrode 2, a similar advantage can be provided.

As the recording material used with the embodiment, any of charged powder, liquid containing charged particles, or conductive liquid can be used and an electrophotographic developer can also be used suitably.

Figure 3:
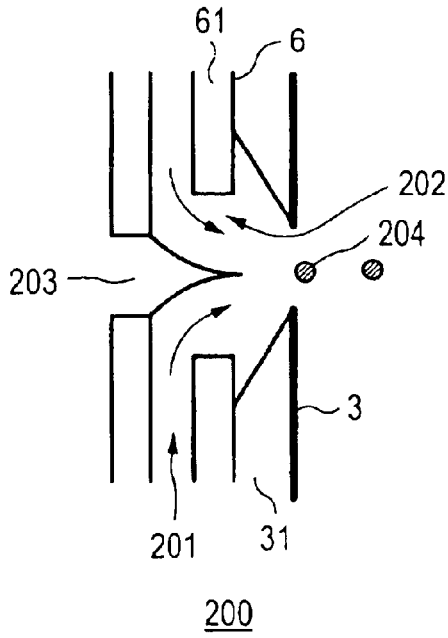
FIG. 3 is a drawing to show acceleration unit using an air flow.

The effect of the electric field diverged in the direction of the intermediate electrode from the recording head on ejecting of toner depends on the magnitude of the kinetic energy of the toner. Thus, if the toner can be ejected at high speed, the straight movability of the toner can be improved against the electric field line. Specifically, as shown in FIG. 3, as acceleration unit 200, an air flow 201 supplied from an air source (not shown) is always ejected from an air outflow passage 202, whereby it is made possible to accelerate toner 204 ejected from a recording head 203, and the toner can be ejected at high speed. Further, as the toner is ejected at high speed, it is made possible to make a high-speed response and improve accuracy of hitting position.

Figure 4:
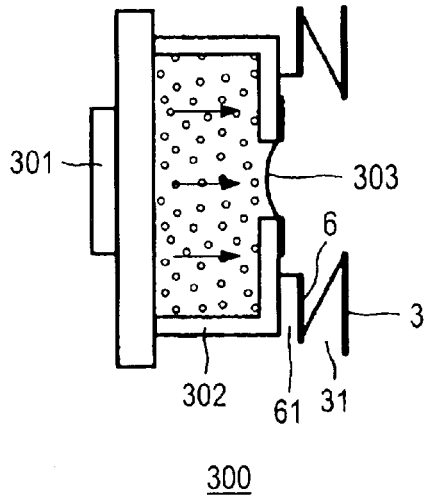
FIG. 4 is a drawing to show supply means using vibration.

To make a high-speed response, toner needs also to be supplied to the head ejection part quickly. Then, as shown in FIG. 4, as supply means 300 of toner to the head ejection part, ultrasonic waves are applied to a recording head 302 by an ultrasonic vibrator 301 for vibrating toner 303, whereby the toner can be moved in the ejection part direction and it is made possible to supply the toner quickly.

In the embodiment, ultrasonic waves generated from the piezoelectric element are used for ejecting toner from the recording head. However, the invention is not limited to it. With the ink jet record technique using piezo elements, heating resistors, an electrostatic force, etc., a similar advantage is also provided. In the ink jet record technique using an electrostatic force, an image signal voltage is superposed on the ejection part electrode 2, whereby the ink can be ejected. In the toner jet record technique for ejecting powder toner by an electrostatic force, a similar advantage is also provided.

As described above, according to the invention of the first aspect, if the predetermined voltage is applied to the auxiliary electrode, the electric field line diverged in the direction of the intermediate electrode from the recording head is corrected in the straight line direction for flattening the potential gradient, so that a good electric field can be formed between the recording head and the intermediate electrode and the charged matter can be stably ejected without disordering the ejecting direction of the charged matter for forming a good image on the record medium.

According to the invention of the second aspect, the voltage applying unit applies the predetermined voltages to the ejection part electrode, the intermediate electrode, and the auxiliary electrode, whereby the potential gradient between the recording head and the intermediate electrode is flattened and weakened, so that a good electric field can be formed between the recording head and the intermediate electrode and the charged matter can be stably ejected without disordering the ejecting direction of the charged matter for forming a good image on the record medium.

According to the invention of the third aspect, the base material of the auxiliary electrode is a material having a low dielectric constant of 3 or less, so that formation of a new electric field line is suppressed and ejecting of the charged matter is prevented from being adversely affected.

According to the invention of the fourth aspect, the edge of the intermediate electrode is formed at an acute angle (45 degree or less, preferably 20 degrees or less), so that the intermediate electrode is located away from the top of the recording head ejecting the charged matter and thus an electric field line is generated from the ejection part electrode placed in the proximity of the ejection part in the outer peripheral portion of the ejection part and can be prevented from concentrating on the material having a high dielectric constant so as not to adversely affect electric field formation in the proximity of the recording head.

According to the invention of the fifth aspect, for example, to positively charge the ejected charged matter, if the voltage applying unit applies 500 V to the intermediate electrode 3, 1500 V to the auxiliary electrode 6, and 1000 V to the ejection part electrode 2, for example, so as to satisfy the relation $V1<V2\leqq V3$ wherein V1 is the voltage applied to the intermediate electrode, V2 is the voltage applied to the ejection part electrode, and V3 is the voltage applied to the auxiliary electrode, the potential gradient between the recording head and the intermediate electrode is flattened and is diverged in the direction of the intermediate electrode and is weakened, so that the charged matter can be stably ejected without disordering the ejecting direction of the charged matter for forming a good image on the record medium.

According to the invention of the sixth aspect, as ink particles are accelerated with the aid of an air flow, it is made possible to eject the ink particles at high speed, so that the straight movability of the ink particles can be improved against the electric field line diverged in the intermediate electrode from the recording head.

According to the invention of the seventh aspect, as vibration is applied to the recording head, ink can be moved to the top of the recording head, so that it is made possible to supply the ink quickly.

What is claimed is:

1. An image forming method comprising steps of: ejecting charged matter from a recording head placed opposed to a record medium by applying an external force to the charged matter; applying a voltage to an intermediate electrode installed between the recording head and the record medium and control ling flying of the ejected charged matter; applying a predetermined voltage to an auxiliary electrode placed between the intermediate electrode and the recording head, and controlling a potential gradient between the recording head and the intermediate electrode; and hitting the charged matter on the record medium.

2. An image forming apparatus comprising: an ejection part electrode placed in the proximity of an ejection part of a recording head placed opposed to a record medium; an intermediate electrode placed between the recording head and the record medium; an auxiliary electrode placed between the recording head and the intermediate electrode; and voltage applying unit applying predetermined voltages to the ejection part electrode, the intermediate electrode, and the auxiliary electrode, wherein the charged matter ejected from the ejection part of the recording head placed opposed to the record medium flies by applying the external force to the charged matter and hits on the record medium, thereby forming an image on the recording medium.

3. The image forming apparatus as set forth in claim 2 wherein the auxiliary electrode further comprises a base material of the auxiliary electrode, the base material being a material having a dielectric constant of 3 or less.

4. The image forming apparatus as set forth in claim 2 wherein the intermediate electrode further comprises a base material of the intermediate electrode, and the edge of the base material is formed at an acute angle.

5. The image forming apparatus as set forth in claim 2 wherein the voltage applying unit applies predetermined voltages to the intermediate electrode, the ejection part electrode, and the auxiliary electrode so as to satisfy relation V1<V2V3 in the case of that the polarity of the charged matter is positively charged and satisfy relation V1>V2V3 in the case of that the polarity of the charged matter is negatively charged and wherein V1 is the voltage applied to the intermediate electrode, V2 is the voltage applied to the ejection part electrode, and V3 is the voltage applied to the auxiliary electrode.

6. The image forming apparatus as set forth in claim 2, further comprising an acceleration unit for accelerating the charged matter ejected from the recording head by an air flow.

7. The image forming apparatus as set forth in claim 2, further comprising a vibration applying unit for vibrating the recording head.

8. The image forming apparatus as set forth in claim 2, wherein the auxiliary electrode is placed close to the center axis extending from the top of the recording head.

9. An image forming apparatus comprising: an ejection part electrode placed in the proximity of an ejection part of a recording head placed opposed to a record medium; an intermediate electrode placed between the recording head and the record medium; an auxiliary electrode placed between the recording head and the intermediate electrode; and voltage applying unit applying predetermined voltages to the ejection part electrode, the intermediate electrode, and the auxiliary electrode, wherein the charged matter is stably ejected without disordering the ejecting direction such that said ejected charged matter from the ejection part of the recording head placed opposed to the record medium is controlled and flies by applying the external force to the charged matter and hits on the record medium, thereby forming an image on the recording medium.

* * * * *